US010072390B2

(12) United States Patent
Van Vessem

(10) Patent No.: US 10,072,390 B2
(45) Date of Patent: Sep. 11, 2018

(54) TUBULAR FOUNDATION ELEMENT, ASSEMBLY AND METHOD FOR INSTALLING TUBULAR FOUNDATION ELEMENTS IN A GROUND FORMATION

(71) Applicant: IHC Holland IE B.V., Sliedrecht (NL)

(72) Inventor: Henricus Gerardus Andreas Van Vessem, Vught (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 15/311,784

(22) PCT Filed: May 13, 2015

(86) PCT No.: PCT/NL2015/050344

§ 371 (c)(1),
(2) Date: Nov. 16, 2016

(87) PCT Pub. No.: WO2015/178765

PCT Pub. Date: Nov. 26, 2015

(65) Prior Publication Data

US 2017/0096791 A1 Apr. 6, 2017

(30) Foreign Application Priority Data

May 22, 2014 (NL) ..... 2012858

(51) Int. Cl.

| | |
|---|---|
| ***E02D 7/06*** | (2006.01) |
| ***E02D 7/28*** | (2006.01) |
| ***E02D 5/28*** | (2006.01) |

(52) U.S. Cl.

CPC ..... *E02D 7/06* (2013.01); *E02D 5/285* (2013.01); *E02D 7/28* (2013.01); *E02D 2250/0092* (2013.01); *E02D 2300/0029* (2013.01)

(58) Field of Classification Search

CPC .. E02D 5/285; E02D 7/02; E02D 7/06; E02D 7/08; E02D 7/10; E02D 7/14; E02D 7/28; E02D 13/00

(Continued)

(56) References Cited

U.S. PATENT DOCUMENTS

| | | | |
|---|---|---|---|
| 3,824,797 | A | 7/1974 | Wisotsky |
| 4,154,307 | A | 5/1979 | Gendron et al. |

(Continued)

FOREIGN PATENT DOCUMENTS

| | | | |
|---|---|---|---|
| CN | 2599075 | Y | 1/2004 |
| CN | 1928251 | A | 3/2007 |

(Continued)

OTHER PUBLICATIONS

International Search Report and Written Opinion for International patent application No. PCT/NL2015/050344, dated Aug. 31, 2015.

(Continued)

*Primary Examiner* — Frederick L Lagman
(74) *Attorney, Agent, or Firm* — Steven M. Koehler; Westman, Champlin & Koehler, P.A.

(57) ABSTRACT

A tubular foundation element, in particular a pile e.g. a jacket pile, to be installed in a ground formation has at least one open end, typically both ends open, allowing a pile driver with an anvil to be inserted into the tubular foundation element. The tubular foundation element comprises a support at the inside thereof, which support is adapted to transmit energy from the anvil directly to the tubular foundation element, during installation of the tubular foundation element.

22 Claims, 2 Drawing Sheets

(58) Field of Classification Search
USPC ..... 405/228, 249
See application file for complete search history.

(56) References Cited

U.S. PATENT DOCUMENTS

| | | | | | |
|---|---|---|---|---|---|
| 5,228,806 | A * | 7/1993 | De Medieros, Jr. | E02B 17/02 | 405/227 |
| 5,257,879 | A * | 11/1993 | Veronelli | E02D 7/28 | 173/81 |
| 5,423,633 | A * | 6/1995 | Verstraeten | E02D 7/28 | 405/228 |
| 5,449,253 | A * | 9/1995 | Roger | E02D 7/28 | 405/232 |
| 6,364,577 | B1 * | 4/2002 | Haney | E02D 13/10 | 173/131 |
| 2007/0075547 | A1 * | 4/2007 | Kothnur | E02D 7/06 | 290/55 |
| 2009/0129871 | A1 | 5/2009 | Mohr | | |
| 2012/0201612 | A1 * | 8/2012 | Westerbeek | E02D 7/28 | 405/232 |

FOREIGN PATENT DOCUMENTS

| | | | | |
|---|---|---|---|---|
| CN | 201068569 | Y | 6/2008 | |
| CN | 202492846 | U | 10/2012 | |
| DE | 1784396 | B1 | 7/1971 | |
| EP | 1482094 | A1 | 12/2004 | |
| EP | 2312060 | A1 | 4/2011 | |
| GB | 215177 | A * | 5/1924 | E02D 7/28 |
| GB | 561765 | A | 6/1944 | |
| GB | 2089407 | A | 6/1982 | |
| JP | S60159218 | A | 8/1985 | |
| JP | H0365737 | A | 3/1991 | |
| WO | 2006117380 | A1 | 11/2006 | |

OTHER PUBLICATIONS

Chinese Office Action for Chinese patent application No. 201580026641.7, dated May 18, 2018, with English translation.

* cited by examiner

TUBULAR FOUNDATION ELEMENT, ASSEMBLY AND METHOD FOR INSTALLING TUBULAR FOUNDATION ELEMENTS IN A GROUND FORMATION

CROSS-REFERENCE TO RELATED PATENT APPLICATION

The present application is a national phase of and claims priority of International patent application Serial No. PCT/NL2015/050344, filed May 13, 2015, and published in English the content of which is hereby incorporated by reference in its entirety.

BACKGROUND

The present invention relates to a tubular foundation element, in particular a pile e.g. a jacket pile, to be installed in a ground formation, the tubular foundation element having at least one open end, typically both ends open, allowing a pile driver with an anvil to be inserted into the tubular foundation element. The present invention further relates to an assembly for installing tubular foundation elements, in particular piles e.g. jacket piles, in a ground formation, which assembly comprises a pile driver and an anvil. Further, the present invention relates to a method of installing a tubular foundation element, in particular a pile or a jacket pile, in a ground formation, by means of a pile driver.

It is known that pile driving is done by a hammer with a sleeve, wherein the sleeve is stabbed over the pile. The hammer delivers one or more blows to the pile, thereby driving the pile into the ground formation.

It is an object of the present invention to provide a tubular foundation element which does not require or requires less removal of soil material.

SUMMARY

The Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A tubular foundation element comprises a support at the inside thereof, which support is adapted to transmit energy from the anvil directly to the tubular foundation element, during installation of the tubular foundation element.

During installation of the tubular foundation element, a driver is placed on the support provided at the inside of the tubular foundation element and the tubular foundation element penetrates the soil material of the ground formation, in particular an underwater ground formation, and the soil material enters the tubular foundation element. At a predetermined point during driving of the tubular foundation element, the anvil and the support hit the soil material, thereby forcing the soil material to move downwards. As a result, the part of the tubular foundation element above the support contains no or little soil material.

Moreover, the soil material within the tubular foundation element is compressed during installation of the tubular foundation element and, therefore, becomes more dense. If a further element is inserted into the tubular foundation element, for instance a jacket leg of a jacket, grout may be provided around the further element and within the tubular foundation element to provide a fixation of the further element relative to the tubular foundation element. Due to the more dense soil material, mixing of the grout with the soil material may be prevented or reduced and grouting is improved.

It is noted that in the context of the present patent application, the term directly is referred to as without changing direction, and is also referred to as with nothing in between. Thus, the energy transmitted from the anvil to the tubular foundation element does not change direction during transmittal as such.

In a preferred embodiment, the support is provided in the upper half of the tubular foundation element, in particular in the upper quarter of the tubular foundation element. In this respect, 'upper' refers to a tubular foundation element which is vertically oriented. In a more specific embodiment, the tubular foundation element has a length in a range from 20 to 120 m, preferably in a range from 40 to 70 m, and the support is placed at a distance from the at least one open end, which distance is in a range from 4 to 10 m, in particular in a range from 6 to 8 m, and/or in a range from 7% to 30%, in particular in a range from 10% to 25% of the total length of the tubular foundation element. In this embodiment, the upper part of the tubular foundation element, i.e. the part above the support, stays clean during installation of the tubular foundation element. In the upper part, a jacket leg may be inserted and fixed with respect to the tubular foundation element by means of grout. Due to the clean upper part of the tubular foundation element, no removal of soil material is required before grouting.

The support may comprise a flange secured to an inner surface of the tubular foundation element. The flange may be secured, e.g. welded or bolted, to the inner surface, in particular an inner wall of the tubular foundation element.

The support may be substantially tapered towards the toe of the tubular foundation element in the longitudinal direction thereof. In this respect, 'toe' refers to the lowermost end of the tubular foundation element. Due to the tapered shape of the support towards the toe of the tubular foundation element, the energy delivered via the anvil to the support is transmitted efficiently to the wall of the tubular foundation element.

The invention further relates to a method of installing a tubular foundation element in a ground formation, by means of a pile driver. The method comprises the steps of providing a tubular foundation element with a support at the inside thereof; placing an anvil on the support; placing the driver on the anvil; and driving the tubular foundation element into the ground formation, wherein during installation the support transmits energy from the anvil directly to the tubular foundation element.

The support may be provided in the upper half of the tubular foundation element, in particular in the upper quarter of the tubular foundation element. In this respect, 'upper' refers to a tubular foundation element which is vertically oriented.

In an embodiment the driver and/or anvil are held by the tubular foundation element during driving thereof.

In a preferred embodiment, the tubular foundation element is placed directly on the ground formation and driven into the ground formation. In a more specific embodiment, the anvil compresses soil material of the ground formation within the tubular foundation element during at least a part of a installing process of the tubular foundation element. Usually, the upper layer of the ground formation, in particular underwater ground formation, has to be excavated before the tubular foundation element may be installed in the ground formation.

Thus, as explained above, the upper part of the tubular foundation element, i.e. the part above the support, contains no or little soil material after installation of the tubular foundation element. Therefore, the upper part of the tubular foundation element does not require to be emptied after installation. Further, the soil material within the tubular foundation elements is compressed during installation of the tubular foundation element. Due to the compression of the soil material of the ground formation, the soil material of the ground formation, in particular the upper layer, is more dense after installation.

Due to compression of the soil material during installation, the tubular foundation element may be placed onto the ground formation, in particular a ground formation with a soft upper layer, without excavating the upper layer of the ground formation.

The method may further comprise a step of placing a template having at least two guides for guiding a tubular foundation element on the ground formation, in particular before the tubular foundation element is placed on the ground formation.

In an embodiment, when the tubular foundation element is installed in an underwater ground formation, water may be relieved from the tubular foundation element, in particular at least from the part between the underwater ground formation and the support, during installation of the tubular foundation element in the underwater ground formation.

The invention further relates to an assembly for installing a tubular foundation element as presently provided, in a ground formation, comprising a pile driver and an anvil, wherein the support at the inside of the tubular foundation element is adapted to transmit energy from the anvil directly to the tubular foundation element, during installation of the tubular foundation element. It is preferred that the pile driver comprises a hydraulic pile driver.

The assembly may comprise a template having at least two guides for guiding a tubular foundation element, which template is to be placed on the underwater ground formation, at least during installing the tubular foundation element.

BRIEF DESCRIPTION OF THE DRAWINGS

Aspects of the invention will be explained in greater detail by reference to exemplary embodiments of the invention shown in the drawings, in which.

DETAILED DESCRIPTION OF ILLUSTRATIVE EMBODIMENTS

In practice, installation of a jacket, e.g. for a wind turbine, starts with installing a number a jacket piles in a ground formation, e.g. an underwater ground formation. After installing the jacket piles, jacket legs of the jacket are placed within the jacket piles. A jacket leg extends in the upper part of a jacket pile. Grout may be added to the jacket pile, in particular the upper part of the jacket pile, in order to fixate the jacket leg with respect to the jacket pile.

Figure 1:
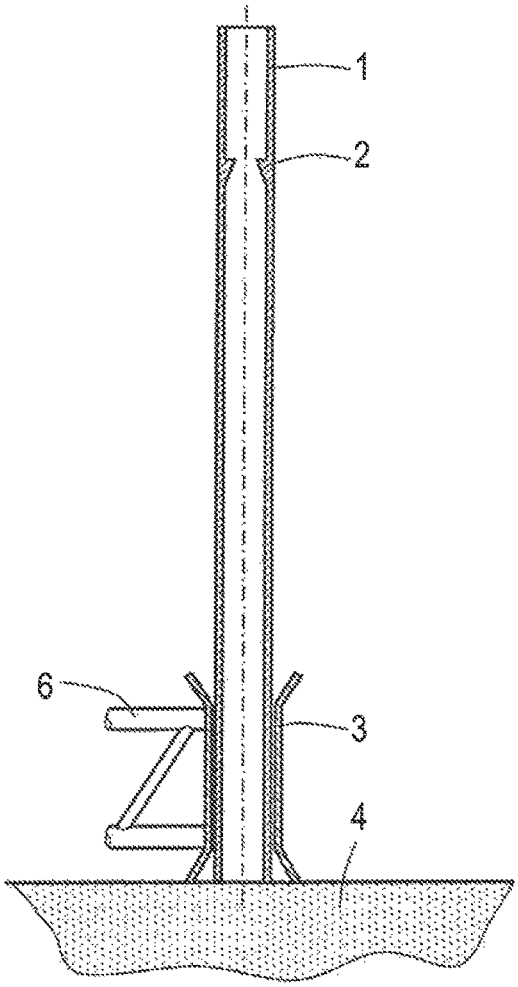
FIGS. 1 and 2 illustrate the different stages of installing a tubular foundation element in a ground formation.

To this end, FIG. 1 shows an embodiment of a tubular foundation element 1, in this embodiment a jacket pile 1 which might be installed in an underwater ground formation 4. The tubular foundation element 1 is placed on the surface of the underwater ground formation 4 and is held by a guide 3 of a template 6. In this example, the jacket pile 1 has a circular cross-section and a diameter in the range from 1.5 to 3.5 m.

The jacket pile 1 is provided with a support, in this embodiment a flange 2 provided at an inner wall of the jacket pile 1. The flange 2 is attached to the inner wall of the jacket pile 1 by, e.g. welding, bolting, or any suitable manner to attach the flange 2 to the inner wall of the jacket pile 1.

In an embodiment, the flange 2 may be provided with openings (not shown) in order to let water out from the lower part of the jacket pile 1 below the flange 2. It is therewith prevented that the water pressure within the lower part of the jacket pile 1 exceeds a predetermined value as a result of driving the jacket pile 1 by means of the driver 4, in particular a hydraulic driver, which driver delivers blows to the flange 2. In this embodiment the blows are delivered directly to an upper side, i.e. top surface of the flange 2.

In other embodiments, openings (not shown) might be provided in the tubular foundation element 1 and/or in an anvil 8 to let water out from the lower part of the tubular foundation element 1 below the support 2.

Figure 3:
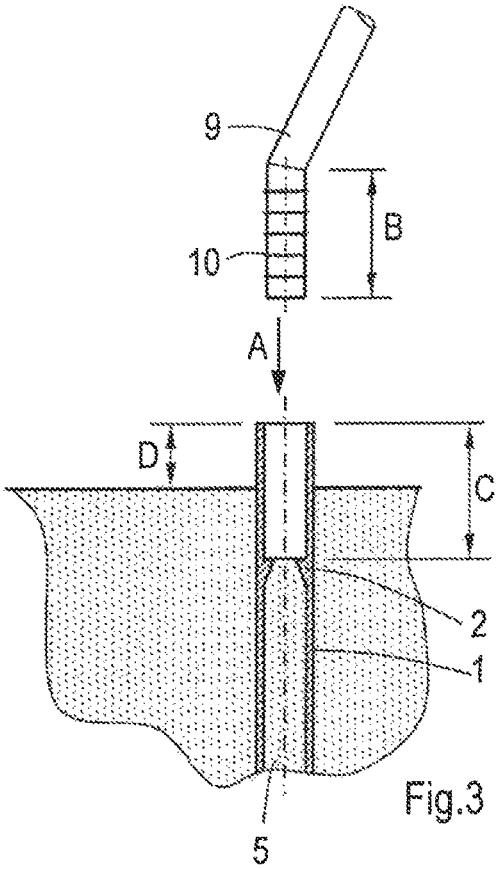
FIG. 3 illustrates an installation of a jacket leg in the tubular foundation element of FIGS. 1 and 2.

As can be seen in FIG. 3, when the jacket pile 1 is installed in the underwater ground formation 4, the flange 2 is below the surface of the underwater ground formation 4.

Figure 2:
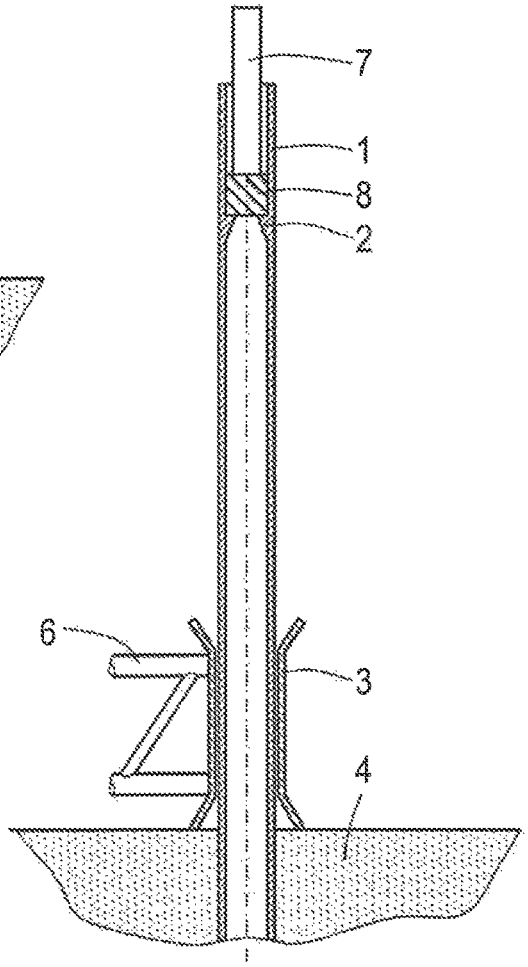

As can be seen in FIG. 2, a driver 7 with an anvil 8 is placed on top of the support 2, such that energy is transmitted from the anvil 8 directly to the tubular foundation element 1, during installation of the tubular foundation element 1. The driver 7 and the anvil 8 deliver blows to the flange 2 and therewith to the tubular foundation element 1 to install the tubular foundation element 1 in the underwater ground formation 4. At a predetermined point during installing of the tubular foundation element 1, the flange 2 and the anvil 8 reach the surface of the underwater ground formation 4.

Installing of the tubular foundation element 1 continues and the flange and in particular the anvil 8 delivering blows to the flange 2 of the tubular foundation element 1 deliver blows to the soil material within the tubular foundation element. As a result, the soil material 5 within the tubular foundation element 1 is compressed and becomes more dense, at least the soil material directly below the anvil 8 and the flange 2.

It is noted that the driver 7 with the anvil 8 can be hosted by a hoisting device such as a crane (not shown), which crane is for example placed on a surface vessel, such as a jack-up barge (not shown). The driver may be a hydraulic driver, e.g. one out of the IHC Hydrohammer S-series connected to a power pack on board of a surface vessel (not shown).

In practice the length B of the legs of the jacket in FIG. 3 may be 5 m. In the installed state, the tubular foundation element 1 may extend a distance D above the surface of the underwater ground formation 4, which distance D in this example is 1.5 m. The length C is in this example in a range from 4 to 10 m, in particular in a range from 6 to 8 m, and/or in a range from 7% to 30%, in particular in a range from 10% to 25% of the total length of the tubular foundation element 1.

Due to the anvil 8 with the driver 7 forcing the soil material to move downwards during driving of the tubular foundation element 1, it is not required to empty the part of the tubular foundation element 1 above the flange 2 after installation. As a result of compressing the soil material within the tubular foundation element 1, the soil material is more dense and is a good match for the grout used to fixate the jacket leg 9 relative to the jacket pile 1, i.e. grouting is improved.

In this embodiment, the jacket leg 9 comprises welding beads 10, which may contribute to the fixation of the jacket leg 9 to the tubular foundation element 1. The jacket leg 9 is inserted partly into the tubular foundation element 1 as indicated with arrow A.

As a further result, the compressed soil material is more dense. Due to the more dense soil material, mixing of the grout and the soil material is prevented or reduced, which leads to a reliable fixation of the jacket leg to the tubular foundation element 1.

Further advantages of the tubular foundation element as presently provided are as follows. The tubular foundation element 1 is installed in the ground formation by driving within the tubular foundation element 1. As a result thereof, the tubular foundation element 1 acts as a noise reducing element. As a further result, the diameter of the tubular foundation element 1 is not enlarged during driving. Thus the tubular foundation element 1 may be installed without additional structural elements at the outside of the foundation element and/or without adjusting the guide 3 of the template 6.

A further advantage is a low center of gravity due to the pile driver 7 being inserted in the tubular foundation element 1 during driving thereof.

Moreover, since the anvil 8 is placed on the support 2 during driving of the tubular foundation element 1, energy delivered to the support by, i.a. the anvil 8 is transmitted to the wall of the tubular foundation element. The transmitted energy is in particular transmitted downwards, i.e. via the wall of the tubular foundation element 1, in particular from the support 2 towards the toe of the tubular foundation element. As a result, the part of the tubular foundation element 1 contributing to the generation of noise is reduced.

It should be appreciated, however, that these embodiments may not be construed as limiting the scope of protection for the present invention.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral.

The invention is not restricted to the above-described embodiments, which can be varied in a number of ways within the scope of the claims. It is, for example possible that a noise mitigation system is used during installing of the tubular foundation element. The noise mitigation system comprises a tubular sleeve, which can be placed around the tubular foundation element during driving thereof. The tubular sleeve reduces the noise produced during driving of the tubular foundation element. The noise mitigation system may be used in combination with a template as described above.

In a further embodiment, the tubular foundation element is composed of multiple parts, in particular cylindrical parts, which are placed on top of each other. One of the parts comprises a support, which might have a length in a range from 5-25 cm, in particular in a range from 10 to 15 cm.

The invention claimed is:

1. A system comprising:

an anvil comprising a bottom surface;

a tubular foundation element configured for installation in a ground formation comprising:

an elongated member having an open end; and support at the inside of the elongated member comprising a flange secured to an inner surface of the elongated member, wherein the support is located in an upper half of the elongated member; and wherein the anvil and the tubular foundation element are configured such that during installation of the elongated member:

the bottom surface of the anvil is entirely received within an interior of the elongated member through the open end;

an outer portion of the bottom surface directly engages the flange;

the bottom surface of the anvil covers an opening extending radially from a central axis of the elongated member to the flange; and energy is transmitted from the anvil directly to the elongated member through the flange.

2. The system according to claim 1, wherein the elongated member has a length in a range from 20 to 120 m, and wherein the support is placed at a distance from the open end, wherein the distance is in a range from 4 to 10 m.

3. The system according to claim 1, wherein the support is substantially tapered towards a toe of the elongated member remote from the open end in a longitudinal direction thereof.

4. The system according to claim 1, wherein the elongated member includes two open ends.

5. The system according to claim 1, further comprising a template having at least two guides configured to guide the elongated member at the ground formation.

6. The system according to claim 1, wherein the support is located in an upper quarter of the elongated member.

7. The system according to claim 1, wherein the support is positioned at the inside of the elongated member a distance of 7% to 30% of a total length of the elongated member from the open end.

8. The system according to claim 1, wherein the support is positioned at the inside of the elongated member a distance of 10% to 25% of a total length of the elongated member from the open end.

9. The system according to claim 1 wherein the bottom surface of the anvil is flat.

10. A method of installing a tubular foundation element in a ground formation comprising:

providing a tubular foundation element comprising:

an elongated member having an open end; and a support at the inside of the elongated member comprising a flange secured to an inner surface of the elongated member;

placing an anvil in an installation position, in which a bottom surface of the anvil is entirely received within an interior of the elongated member, an outer portion of the bottom surface directly engages the flange, and the bottom surface of the anvil covers an opening extending radially from a central axis of the elongated member to the flange;

placing a pile driver on the anvil;

installing the tubular foundation element into the ground formation using the pile driver when the anvil is in the installation position comprising delivering energy from the anvil directly to the elongated member through the flange; and compressing soil material of the ground formation within the elongated member during installing the tubular foundation element into the ground formation.

11. The method according to claim 10, wherein the pile driver and/or the anvil are held by the tubular foundation element during driving thereof.

12. The method according to claim 10, further comprising placing the elongated member directly on the ground formation.

13. The method according to claim 10, further comprising guiding the elongated member at the ground formation using a template including at least two guides.

14. The method according to claim 13, further comprising placing the template at the ground formation before the tubular foundation element is placed on the ground formation.

15. The method according to claim 10, wherein the ground formation comprises an underwater ground formation, and the method further comprises relieving water from the elongated member during installing the tubular foundation element into the underwater ground formation.

16. The method according to claim 10, further comprising relieving water from the elongated member through a part positioned between the ground formation and the support during driving the tubular foundation element.

17. A method of installing a tubular foundation element in a ground formation comprising:

providing a tubular foundation element comprising:

an elongated member having an open end; and a support at the inside of the elongated member comprising a flange secured to an inner surface of the elongated member, wherein the support is provided in an upper half of the tubular foundation element;

placing an anvil in an installation position, in which a bottom surface of the anvil is entirely received within an interior of the elongated member, an outer portion of the bottom surface directly engages the flange, and the bottom surface of the anvil covers an opening extending radially from a central axis of the elongated member to the flange;

placing a pile driver on the anvil; and installing the tubular foundation element into the ground formation using the pile driver when the anvil is in the installation position comprising delivering energy from the anvil directly to the elongated member through the flange.

18. The method according to claim 17, further comprising compressing soil material of the ground formation within the elongated member during installing the tubular foundation element into the ground formation.

19. A system comprising:

an anvil comprising a bottom portion with a bottom surface;

a tubular foundation element configured for installation in a ground formation comprising:

an elongated member having open upper and lower ends; and a support at the inside of the elongated member comprising a flange secured to an inner surface of the elongated member;

wherein the anvil and the tubular foundation element are configured such that during installation of the elongated member:

the bottom portion of the anvil covers an opening extending radially from a central axis of the elongated member to the flange; and soil that enters an interior of the elongated member through the lower end is compacted by the bottom surface of the anvil; and energy is transmitted from the bottom surface of the anvil directly to the elongated member through the flange while the bottom surface of the anvil is entirely within an interior of the elongated member, wherein the opening and the bottom surface of the anvil are configured to compact soil below the flange and the bottom surface of the anvil through the opening as energy is transmitted from the bottom surface of the anvil directly to the elongated member through the flange.

20. The system of claim 19 wherein the bottom surface of the anvil is flat.

21. The system according to claim 19, wherein the flange is secured to the inner surface of the elongated member at a location that is closer to the upper end than the lower end.

22. A system comprising:

an anvil comprising a bottom surface;

a tubular foundation element configured for installation in a ground formation comprising:

an elongated member having an open end; and support at the inside of the elongated member comprising a flange secured to an inner surface of the elongated member, wherein the elongated member has a length in a range from 20 to 120 m, and wherein the support is placed at a distance from the open end, wherein the distance is in a range from 4 to 10 m; and wherein the anvil and tubular foundation element are configured such that during installation of the elongated member:

the bottom surface of the anvil is entirely received within an interior of the elongated member through the open end;

an outer portion of the bottom surface directly engages the flange;

the bottom surface of the anvil covers an opening extending radially from a central axis of the elongated member to the flange; and energy is transmitted from the anvil directly to the elongated member through the flange.

* * * * *